United States Patent [19]

Zsóka et al.

[11] Patent Number: 4,499,947

[45] Date of Patent: Feb. 19, 1985

[54] PACKER FOR SEPARATION OF ZONES IN A WELL BORE

[75] Inventors: István Zsóka; László Madar, both of Budapest, Hungary; Anatoly A. Cübin, Moscow, U.S.S.R.; Albert A. Gaivoronsky, Moscow, U.S.S.R.; Lev H. Farukshin, Moscow, U.S.S.R.; Piotr A. Morzsic, Luberci, U.S.S.R.; Aleksandr I. Lisov; Vladilen A. Galusztainc, both of Moscow, U.S.S.R.

[73] Assignees: Magyar Szenhidrogenipari Kutatofejleszto Intezet, Szazhalombatta, Hungary; Vsesojuzny Nauchno-Issledovatelsky Institut Burovoi Technici, Moscow, U.S.S.R.

[21] Appl. No.: 560,264

[22] Filed: Dec. 12, 1983

[51] Int. Cl.[3] ..... E21B 33/127

[52] U.S. Cl. ..... 166/179; 166/187

[58] Field of Search ..... 166/179, 184–188, 166/194, 196, 317, 318, 334, 386, 387, 323, 319, 166/321

[56] References Cited

U.S. PATENT DOCUMENTS

| | | | |
|---|---|---|---|
| 3,053,322 | 9/1962 | Kline | 166/187 |
| 3,270,814 | 9/1966 | Richardson et al. | 166/187 |
| 3,422,673 | 1/1969 | Lebourg | 166/187 |
| 3,527,296 | 9/1970 | Malone | 166/187 |
| 3,575,237 | 4/1971 | Malone | 166/187 X |

*Primary Examiner*—Stephen J. Novosad
*Assistant Examiner*—Thuy M. Bui
*Attorney, Agent, or Firm*—Young & Thompson

[57] ABSTRACT

The invention relates to a packer for separation of zones behind casing in a well bore. It comprises a casing string serving as mandrel for the packer, an expandable packing element and first and second sleeves tightly fixed to the peripheries of the packing element, wherein the first sleeve is sealed and movable in respect of the casing string and the second sleeve is tightly fixed to the casing string.

According to the improvement in this invention, a sleeve plug slides on and is sealed against the casing string and has a thicker upper part and a thinner lower part, the upper part is slidingly arranged at least partially between the casing and the collar and is sealed against both of them, the lower part is slidingly arranged at least partially between the casing and the packing element. The first sleeve slides tightly on the sleeve plug. A non-return valve in the casing connects the inside and the outside of the casing at the packing element. A bore in the lower portion of the sleeve plug connects the outside of the casing and the inside of the packing element. Another bore in the casing above the upper portion of the sleeve plug connects the outside of the casing and the inside of the collar.

5 Claims, 3 Drawing Figures

PACKER FOR SEPARATION OF ZONES IN A WELL BORE

Figure 1:
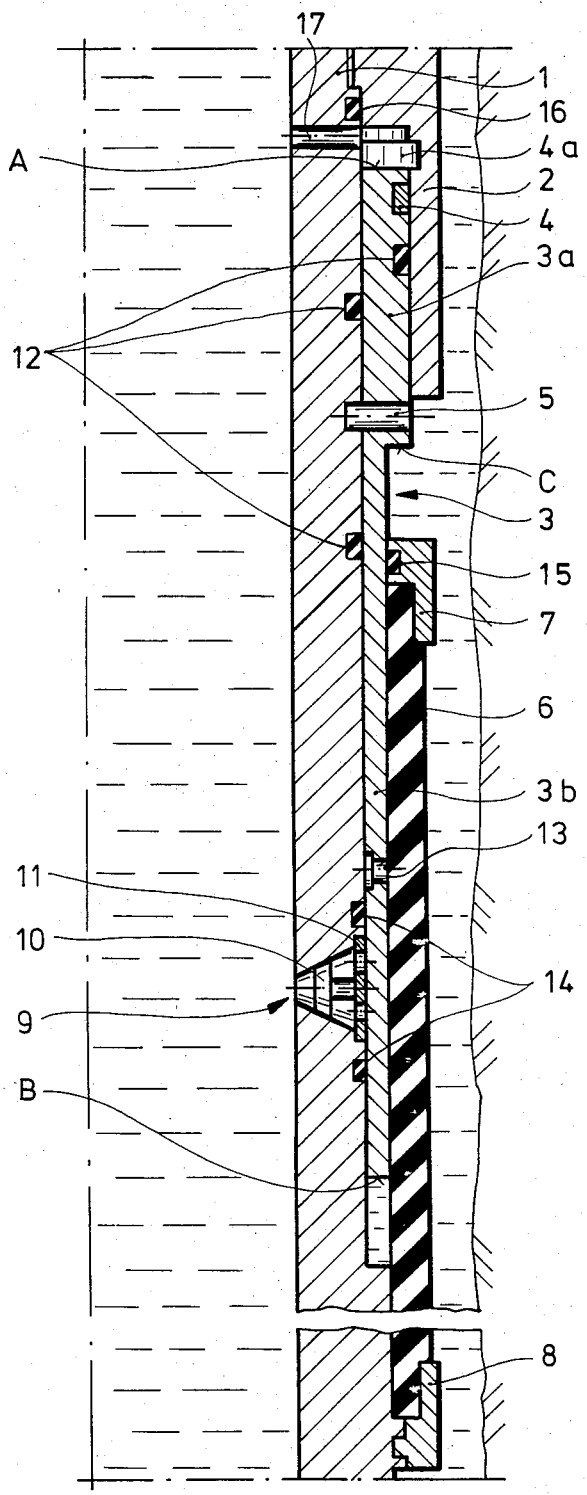

The invention relates to a packer arrangement for separation of zones behind casing in a well bore.

The packer arrangement comprising a casing string serving as mandrel for the packer, an expandable packing element and first and second sleeves tightly fixed to the peripheries of said packing element, wherein the first sleeve is sealed and movable in respect of and the second sleeve is fixed to the casing string, is well known in the prior art and is described in e.g. US-PS No. 3,776,308 or in the "Composite Catalog of Oilfield Equipment and Services", 34th Revision 1980–81, Volume 3, pg. 4722–4723 or in USSR Author's Certificate No. 327 316.

The packer arrangements are used to stop interzonal communication behind casing, i.e. in the annular space between the casing string and the bore hole and, thus, to enhance the filling out of this annular space with cement.

The bore hole often connects zones with different pressure and/or containing different phases such as mud, liquid, gas, rock etc. Thus, the cement jobs can be damaged in the process of perforating, acidizing and fracturing.

The known packers as described hereinabove are an integral part of the casing string and are designed to provide a positive seal between the outer surface of the casing and the open hole well bore. The expandable packing element can be inflated by mud, water, pressurized gas or any agent normally available. The inflation agent is retained under pressure in the packing element in the course of cementing while the pressure inside the casing string is blown off. For this, a quite complicated series of valves is used.

In the packer known from the above said catalogue, there are two double seal check valves and one shut-off valve. Thus, the inflating agent enters the packing element through a series of three valves. The first type of difficulties bound to the known solutions arises from the use of such a sophisticated valve assembly, from the sensitiveness to sanding up or blocking up of the packer.

The valve arrangement is actuated in the known solutions by the cement wiper plug following the cement column which is forced by this plug into the annular space between the outer surface of the casing and the open hole well bore. The plug when going down removes a break-off road projecting from the casing into the way of motion of the plug and connected to the shut-off valve. Thus, the plug actuates the shut-off valve and the pressure applied to the casing inflates through a series of valves the packing element which will be pressed against the inner surface of the well bore.

With this, the spaces below and above the packer are separated from each other. Thus, the upward motion of the cement in the annular space is blocked, too. This means, that the amount of cement being in the annular space at the moment of removing the break-off road by the plug must be enough to do all of the necessary cementing jobs. For solving this problem, the use of delaying equipments was suggested which enlarged the complexity and sensitiveness to damages of the valve arrangement.

When the plug comes to a seat in the casing, the pressure is released from the casing, the shut-off valve locks and the check valves close, if they function properly. The pressure in the packing element must be remain stable at least for the time of hardening the cement.

However, the most significant difficulty of use of the known packers is in the fact, that in one casing, only a single packer can be used. If there were two of them, the first would be activated when the plug passes by and the annular space between the outer surface of the casing and the well bore would be blocked, more cement could not be pressed into it; the plug could not come to its seat at the bottom of the casing and the second packer could not be actuated at all.

The first and main object of this invention is to eliminate the defficiencies of the known solutions. A further object is to create a packer arrangement in which the valve assembly is less complicated and thus, its function is more secure, its fabrication is cheaper, and in the case of which, more packers can be used with one casing.

The basic idea of our invention is in that the valve assembly should be simplified and it should be controlled by the pressure in the casing rather than by the motion of the cement wiper plug.

According to the invention, a collar is tightly fixed to the casing string for being in the annular space between the outer surface of the casing and the well bore and a sleeve plug is provided which is sealed against and slides on the outer surface of the casing from a starting position to a lower position and, further, to a final position. The sleeve plug has a thicker upper part and a thinner lower part. The upper part is arranged between the outer surface of the casing and the inner surface of the collar and is sealed against both of them. The lower part is slidingly arranged at least partially between the outer surface of the casing and the inner surface of the packing element and is sealed against both of them. The first sleeve connected to the packing element is sealed against and slides on the sleeve plug. Serving as valve assembly, a non-return valve is provided in the casing between the inside and the outside of the casing at the packing element. Furthermore, two bores are provided, the first one in the lower portion of the sleeve plug connecting the non-return valve and the space between the packing element and sleeve plug in the lower position of the sleeve plug, the second bore is made in the casing string above the upper portion of the sleeve plug in its starting position.

The non-return valve provides a flow path towards the sleeve plug.

In a preferred embodiment, the non-return valve has a valve body and a perforated plate acting as a filter, the valve body trusts on the perforated plate and is made of resilient material.

A shear pin can be provided which fixes the sleeve plug in respect of the casing in the starting position of the sleeve plug.

In an other embodiment, a blocking device can be provided in the upper part of the sleeve plug and in the collar for fixing the sleeve plug in its final position.

Figure 2:
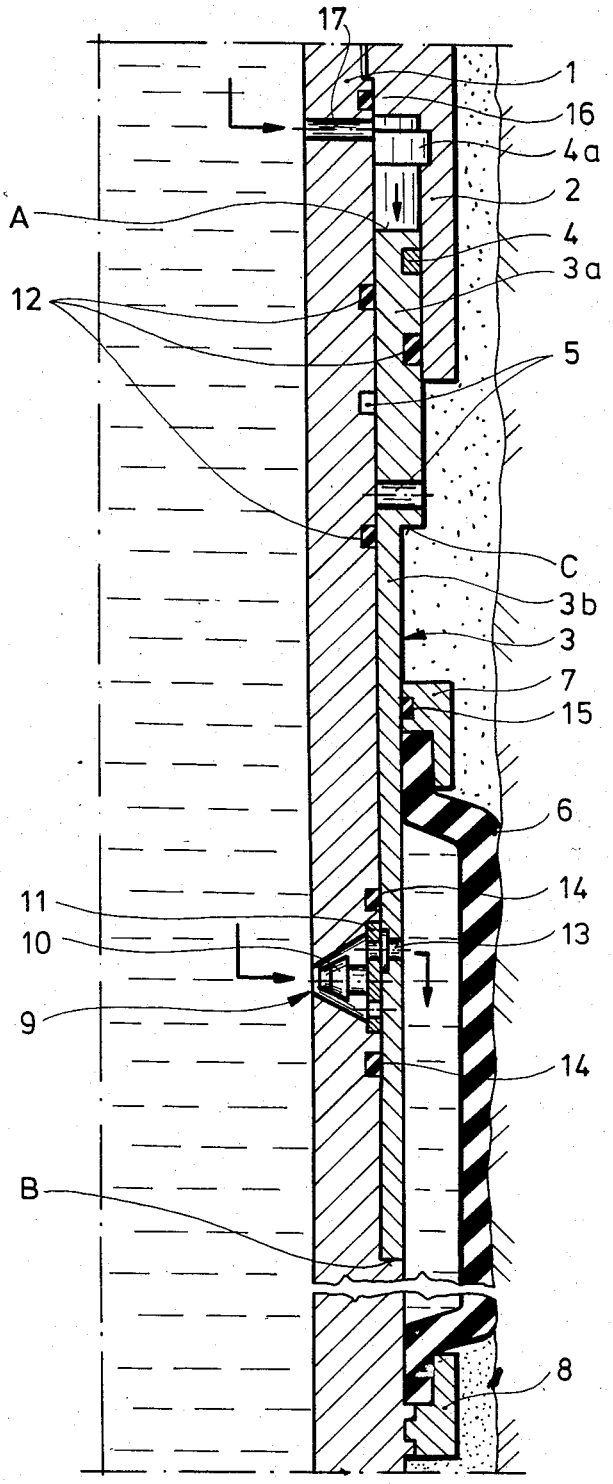
Figure 3:
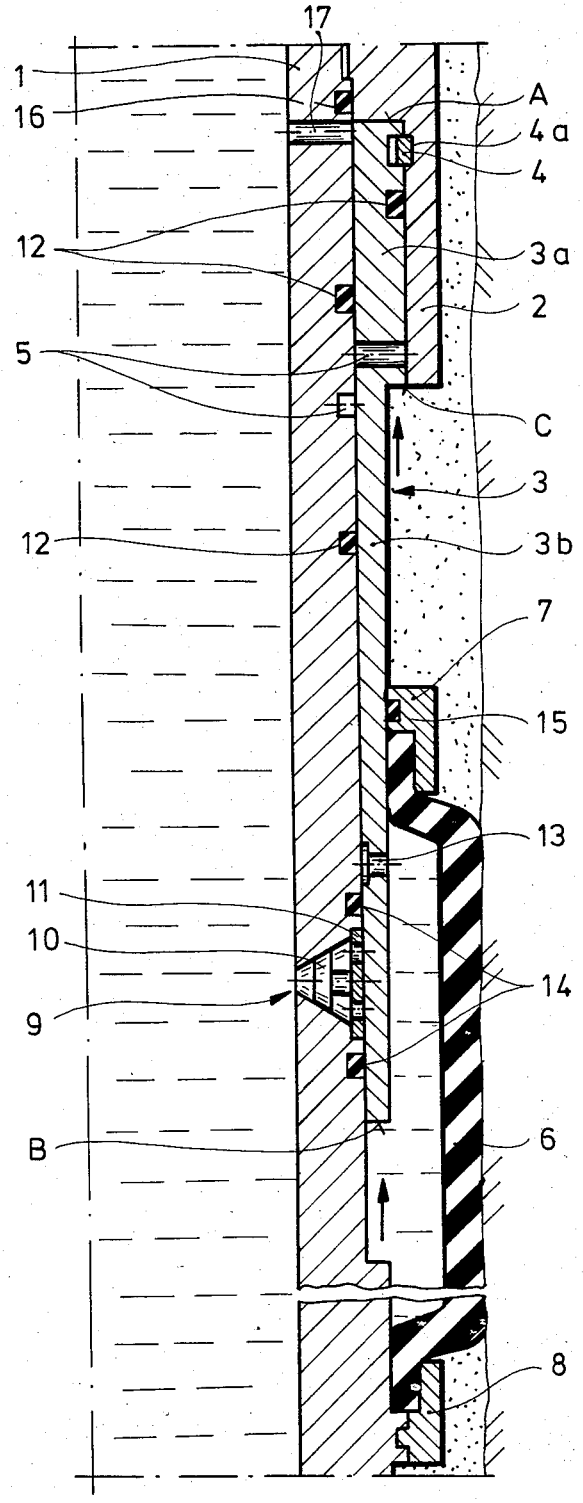

Further details of our invention will be described in connection with a preferred embodiment with reference to the accompanying drawing. In the drawing, FIG. 1 shows a schematic cross section in half of the packer as in this invention, in the starting position of the sleeve plug, FIG. 2 is the same cross section as in FIG. 1 but in the lower position of the sleeve plug, and FIG. 3 is the same cross section as in FIG. 1 but in the final position of the sleeve plug.

In FIG. 1, a portion of the cross section of an open hole bore well is shown, in which casing string 1 is arranged. The portion of the casing string 1 shown in the figure serves as a mandrel for a packing arrangement for the separation of zones behind the casing string 1 in the well bore. On the casing string 1, a collar 2 is tightly fixed forming an annular pocket-like space around the outer surface of the casing string 1.

Under the collar 2 and partly in the pocket-like space, a sleeve plug generally indicated at 3 is provided which is sealed against and slides on the outer surface of the casing string 1. The sleeve plug 3 has a thicker upper part 3*a* and a thinner lower part 3*b* made of one piece. Thus, the upper part 3*a* has an upper end surface A which is greater than a surface C at the step between upper part 3*a* and lower part 3*b*. The lower part 3*b* has an end surface B, too, which is smaller than surface C. Surfaces A, B and C, respectively, serve as work surfaces of the sleeve plug 3.

As it is stated above, the upper part 3*a* is slidingly arranged at least partially in the annular space between the casing string 1 and the collar 2 and is sealed with sealing assemblies 12 against both of them. The lower part 3*b* also slides on and is sealed with sealing assemblies 14 against the casing string 1.

Around the casing string 1, an expandable packing element 6 is arranged, to the peripheries of which a first sleeve 7 and a second sleeve 8 are tightly fixed. The packing element 6 can be made of any suitable material having the proper strength, resilience (expandability) and sealing capability on the outer surface. The material can be a kind of rubber reinforced with e.g. steel cord. Into the rubber, a steel rib can be vulcanized as reinforcement, too. However, the rubber can be replaced with any suitable plastic, as well. Sleeves 7 and 8 are vulcanized or otherwise tightly adhered to the packing element.

The first sleeve 7 slides on and is sealed with sealing assembly 15 against the outer surface of lower part 3*b* of sleeve plug 3. The second sleeve 8 is firmly fixed to the outer surface of casing string 1.

In the casing string 1, a non-return valve 9 is provided which connects the inside and the outside of the casing string 1 essentially at the middle of the packing element 6 in FIG. 1. The non-return valve 9 has a valve tapered bore and a valve body 10 within the bore as well as a perforated plate 11 in alignement of the outer surface of the casing string 1. The valve body 10 is made of a resilient material and trusts on perforated plate 11 which, in turn, serves as a filter. The valve body 10 fits with its sealing surface to the shape of the tapered bore of the non-return valve 9. Thus, it provides a flow path directed towards sleeve plug 3.

In the sleeve plug 3, a bore 13 is made which, in the starting position as shown in FIG. 1, is above the non-return valve 9 and, preferably, above sealing assembly 14.

Furthermore, in the casing string 1, another bore 17 is made above the upper end surface A of sleeve plug 3 in its starting position as shown in FIG. 1. It connects the inside of casing string 1 and the pocket-like space above surface A of collar 2.

The sleeve plug 3 is held in its starting position in respect of the casing string 1 by a shear pin 5.

In FIG. 1, a blocking device 4 in sleeve plug 3 with annular slot 4*a* in the inner surface of collar 2 is shown, too, the function of will be illuminated later.

For the tight connection of casing string 1 and collar 2, a sealing assembly 16 is provided between them.

Describing the function of the packer in our invention, reference is made to FIG. 2 and 3, too. When cementing the space between the outer surface of the casing string 1 and the well bore, cement is forced upwards in this space by a cement wiper plug (not shown) moving down in the inside of and being sealed against the inner surface of the casing string 1. For moving down the cement wiper plug, pressure is applied in the casing string 1 above the plug. When the wiper plug comes to a seat at the bottom of the casing string 1 and all of the cement is forced out of the casing string 1 and into the space to be cementized, the pressure within the casing string will increase. This pressure is constantly communicated via bore 17 in FIG. 1 into the space above sleeve plug 3 and applies a downwardly directed force on the end surface A. On the smaller surface C, a smaller pressure of the cement will cause a much smaller upwardly directed force. At end surface B, there is no pressure at all. When the pressure inside the casing string 1 and, thus, the downwardly directed force at surface A is great enough, the pin 5 will be sheared and the sleeve plug 3 starts a downwards motion. In the course of this, it slides on the outer surface of casing 1, on the inner surface of collar 2 and the first sleeve 7 slides on its outer surface. Finally, sleeve plug 3 reaches its lower position wherein bore 13 is in alignment with the bore of non-return valve 9.

In FIG. 2, the lower position of sleeve plug 3 and the process of setting the packer, i.e. inflation of packing element 6 are shown. The pressure inside the casing string 1 will open the non-return valve 9 by deforming the valve body 10. Afterwards, the pressurized agent, e.g. fluid in the inside of casing string 1 enters the space between sleeve plug 3 and packing element 6 through the opened non-return valve 9 and further through bore 13. As it is clearly shown in the figure, the outer resilient surface of packing element 6 will firmly be pressed against the surface of the well bore.

After the process of setting the packer comes to its end, the pressure inside the casing string will be blown off. Thus, the pressure in the space between sleeve plug 3 and packing element 6 will be greater than in the inside of casing string 1 which, through bore 13, immediately shuts off the non-return valve 9 and exerts at the same time an upwardly directed force on end surface B. As a result of this, the sleeve plug 3 will move upwards and bore 13 leaves non-return valve 9 as well as sealing assembly 14. At the end of this motion, end surface A will impact on collar 2 and blocking device 4 will snap into annular slot 4*a*.

This is the final position of sleeve plug 3 which is shown in FIG. 3. The pressure within the packing element 6 can not escape since the only exit through bore 13 and valve 9 is blocked twice: by sealing assembly 14 and non-return valve 9. Now all jobs in the casing string 1 can be done, the packer will not interrupt its function, at least not during the hardening period of the cement.

It will now be clearly apparent that the packer according to this invention is much more simple in construction and secure in function than the previously known packers.

We claim:

1. A packer for separation of zones behind casing in a well bore comprising a casing string serving as mandrel, for the packer, an expandable packing element, first and second sleeves tightly fixed to the peripheries of said packing element, the first sleeve is sealed and movable in respect of said casing string, the second sleeve is fixed to said casing string, characterized in that a collar (2) is tightly fixed to said casing string (1), a sleeve plug (3) is provided which is sealed against and slides on said casing string (1) from a starting position to a lower position and further to a final position which has a thicker upper part (3*a*) and a thinner lower part (3*b*) made of one piece, the upper part (3*a*) is slidingly arranged at least partially between said casing string (1) and said collar (2) and is sealed against both of them, the lower part (3*b*) is slidingly arranged at least partially between said casing string (1) and said packing element (6), and is sealed against both of them, said first sleeve is sealed against and slides on said sleeve plug (3), a non-return valve (9) is provided in said casing string (1) connecting the inside of said casing string (1) and the space between said casing string (1) and said sleeve plug (3), a bore (13) is made in the lower portion (3*b*) of said sleeve plug (3) connecting the opening of said non-return valve (9) and the space between said packing element (6) and said sleeve plug (3) in its lower position, a bore (17) is made in said casing string (1) above the upper portion (3*a*) of said sleeve plug (3) in its starting position.

2. The packer as claimed in claim 1, wherein said non-return valve (9) provides a flow path directed towards said sleeve plug (3).

3. The packer as claimed in claim 1, wherein said non-return valve (9) has a valve body (10) and a perforated plate (11) acting as a filter and the valve body (10) trusts on the perforated plate (9) and is made of deformable material.

4. The packer as claimed in claim 1, wherein a shear pin (5) is fixing said sleeve plug (3) in respect of said casing string (1) in its starting position.

5. The packer as claimed in claim 1, wherein a blocking device (4) is provided in the upper part (3*a*) of said sleeve plug (3) and in said collar (2) for fixing the sleeve plug (3) in its final position.

* * * * *